United States Patent [19]

Tebbutt

[11] 4,087,018

[45] May 2, 1978

[54] TAMPER PROOF SEAL FOR A CLOSURE

[75] Inventor: Charles Norman Tebbutt, Ruislip, England

[73] Assignee: Metal Box Limited, Reading, England

[21] Appl. No.: 784,462

[22] Filed: Apr. 4, 1977

[30] Foreign Application Priority Data

Apr. 9, 1976 United Kingdom ..... 14543/76

[51] Int. Cl.[2] ..... B65D 51/20

[52] U.S. Cl. ..... 220/257; 220/270; 220/307; 220/359

[58] Field of Search ..... 220/257, 270, 260, 359, 220/307

[56] References Cited

U.S. PATENT DOCUMENTS

| | | | |
|---|---|---|---|
| 1,856,941 | 5/1932 | Anderson | 220/359 X |
| 3,235,121 | 2/1966 | Hexel | 220/260 X |
| 3,552,634 | 1/1971 | Ollier | 220/257 X |

*Primary Examiner*—George T. Hall

*Attorney, Agent, or Firm*—Diller, Brown, Ramik & Wight

[57] ABSTRACT

A lever lid and ring assembly, for a container body, has a tamper indicating sealing member which bridges the joint between the lid and ring. Various shapes of sealing member are described which are cut from aluminium foil coated with a hot melt adhesive. The seals are adhered to an external surface of the ring, and if the shape requires it, they are also sealed to the lid. In an alternative embodiment the sealing member is an annulus of plastics material extruded to seal the joint between the lid and ring.

10 Claims, 7 Drawing Figures

TAMPER PROOF SEAL FOR A CLOSURE

This invention relates to sealing means for tins having a lid removable, by levering, from a ring, and more particularly but not exclusively, to means for sealing the joint between the lid and ring.

Lever lid tins having a cylindrical body closed at one end by a lever lid and ring are known. Such tins are used for dry powders, and commonly have an aluminium foil diaphragm which is held across the mouth of the tin, under the lid and ring, by peripheral engagement with the double seam which joins the ring to the tin body. However, whilst such diaphragms provide a useful moisture vapour barrier, they are not visible until the lever lid is removed and therefore serve only a limited tamperindicating function. Furthermore, a considerable area of aluminium foil is required to seal the tin.

This invention provides a lever lid and ring assembly, suitable for fitting on a tin, said assembly comprising a ring, a lever lid therein and a sealing means, peripherally attached to an exterior surface of the ring, which seals the joint between the ring and lever lid.

In one embodiment the sealing means is an annular disc the outer periphery of which is attached to the ring and the inner periphery is attached to the rim of the lid, so that the joint between lid and ring is sealed. In a preferred embodiment a pull tab extends inwardly from the periphery to help the user to tear the sealing member open.

In an alternative embodiment of the assembly the sealing member is a cured extrudate which bridges the joint between the lid and ring, and is releasably engaged therewith.

Various embodiments of the invention will now be described, by way of example, and with reference to the accompanying drawings, in which.

Figure 1:
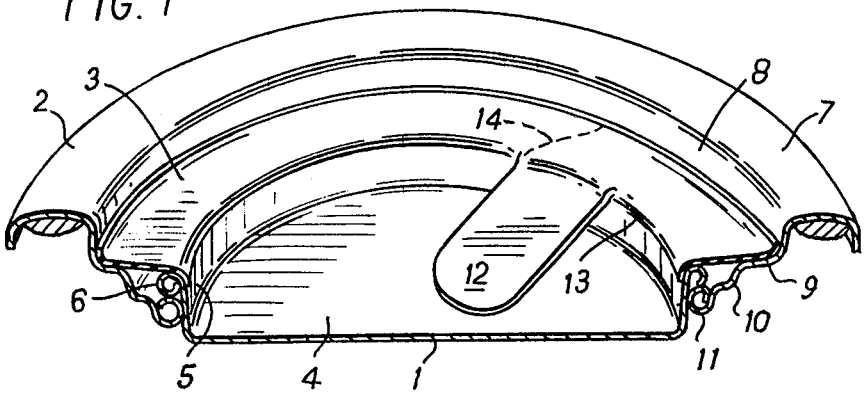
FIG. 1 is a perspective view of an assembly of lever lid, ring and sealing means, sectioned on a diameter.

In FIG. 1 a lever lid 1 is shown fitted in a ring 2. An annular sealing member 3 is attached to an exterior surface of both the ring 2 and the lid 1. The lid and ring are stamped from tinplate.

The lid 1 of FIG. 1 comprises a closure panel 4, and an upstanding peripheral plug wall 5 which terminates in an outwardly directed curl 6.

The ring 2 of FIG. 1 comprises an annular seam hook 7, from the inside of which depends a chuck wall 8 connected to an annular portion 9 which extends radially inwards substantially horizontally and connects with a frustoconical portion 10 which extends downwardly and radially inwardly to an outwardly directed curl 11 which defines the mouth of the ring.

The plug wall 5 of the lid 1 fits in the curl 11 of the ring 2 entry of the lid 1 into the ring 2 being limited by the engagement of the curl 6 of the lid with the curl 11 of the ring 2. The curl can be flattened locally to assist insertion of a lever under the lid for opening.

The annular sealing member 3 is attached to the outward curl 6 of the lid 1 and to the annular portion 9 of the ring 2, and therefore spans and seals the joint between the lid and ring. A pull tab 12 extends radially inwards from the inner edge 13 of the annular sealing member 3. The tab is made a convenient size for gripping and pulling away from the lid and ring. In FIG. 1 an optional line of weakness 14, located to the left of the tab, extends radially across the annular sealing member so that when the tab 12 is pulled upward the sealing means is torn along the line of weakness 14 and thereafter peeled off clockwise from the lid and ring. This tearing of the sealing member provides a tamperindicating feature and removes any possibility of the seal being replaced after opening.

Figure 2:
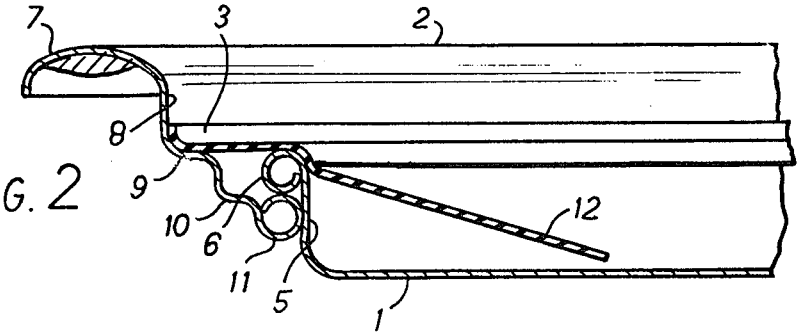
FIG. 2 is an enlarged fragmentary view of the assembly of FIG. 1 sectioned on the centre line of the pull tab of the sealing means.

In FIGS. 1 and 2 it will be seen that the sealing member 3 extends a little way up the chuck wall 8 of the ring and a little way down the plug wall 5 of the lid. This arrangement is a matter of choice of dimensions and convenience for fitting of the seal to the lid and ring. It is only essential in the embodiment of FIGS. 1 and 2 for the sealing member to have adequate anchorage areas on the lid and ring.

Figure 4:
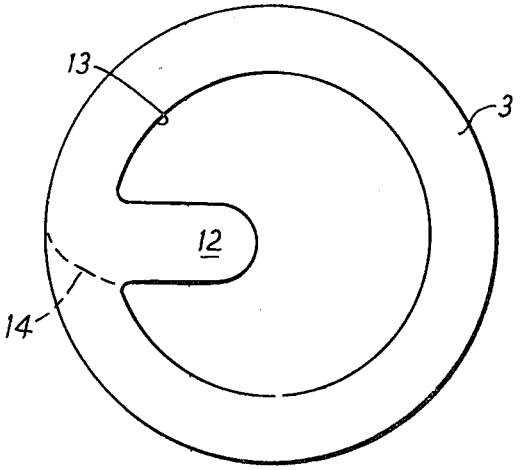
FIG. 4 is a plan view of the sealing means, of FIG. 2, before fitting.

The annular sealing member may be attached to the lid and ring by means of adhesives or welding, but in FIG. 1 the sealing means is a laminate of aluminium foil and a hot melt adhesive material so that the hot melt of the laminate is heat sealed to the lid and ring. FIG. 4 shows the sealing member 3 after cutting from a web of laminate and before fitting on the ring.

Figure 3:
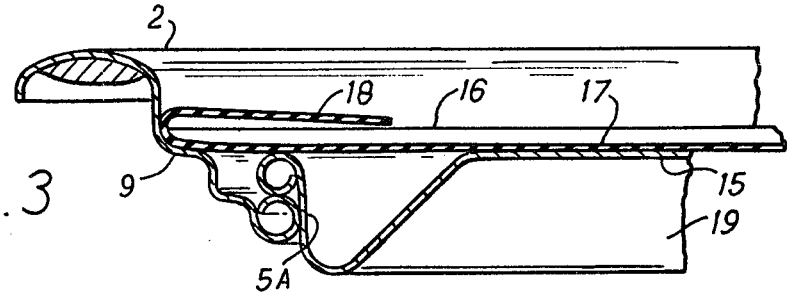
FIG. 3 is a similar view to FIG. 2, of an alternative embodiment of the assembly.

In the alternative embodiment shown in FIG. 3, the ring 2 is identical to that of FIGS. 1 and 2, but the lid 19 is provided with a raised central panel 15 supported by a frustoconical peripheral portion which joins the panel to the plug wall 5A which fits in the ring as already described.

Figure 5:
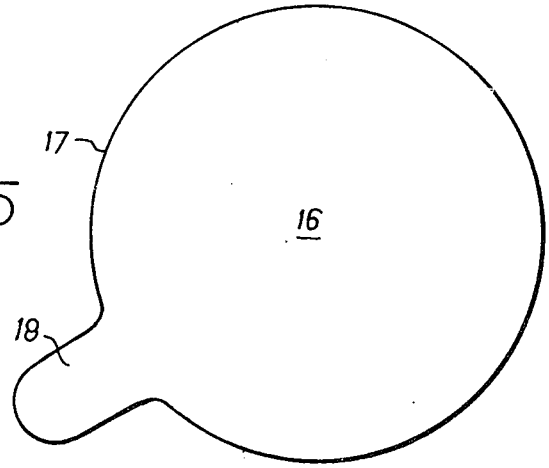
FIG. 5 is a plan view of the sealing means, of FIG. 3, before fitting.

In FIG. 3 the sealing member 16 is in the form of a disc 17 which is peripherally attached to the annular portion 9 of the ring 2 only and extends uninterrupted across the annular portion 9 of the ring to cover the lid 19. In this embodiment a pull tab 18 extends radially outwards from the peripheral edge of the disc 17. FIG. 5 shows the sealing member after cutting from a web of laminated material. When the sealing member 16 has been fitted on to the ring 2, the tab 18 is folded to lie over the disc 17 as shown in FIG. 3 in order to prevent it protruding. It will be understood that the peripheral attachment of the disc 16 to the annular portion 9 of the ring is all that is necessary to seal the lid and ring. The disc may optionally be heat sealed to the lid so that the sealing member lies flat and looks neat.

For reasons of economy the sealing member 3 of FIGS. 1, 2 and 4, which has a large aperture in the centre, may be preferred. However, the seals of FIGS. 5 and 6 provide a surface area for decoration or indicia, which can be more important than the value of recycled scrap.

Figure 6:
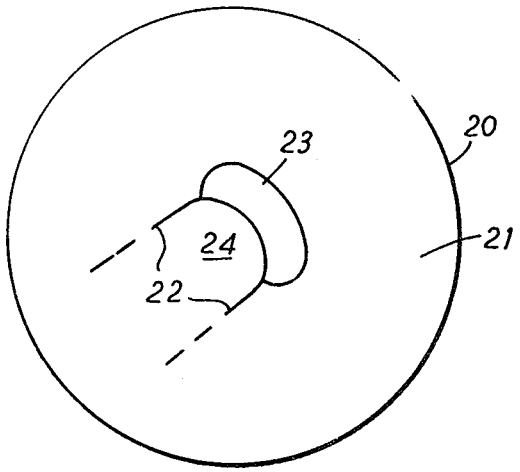
FIG. 6 is a plan view of a further alternative sealing means.

In FIG. 6, the sealing member 20 is in the form of a disc 21 in which the pull tab 24 is defined by a pair of lines of weakness 22 spaced apart and an aperture 23 which, when the seal is fitted on a ring, permits insertion of a finger under the tab so that the tab can be lifted free by tearing along the lines of weakness 22 and thereafter used to pull the sealing member 20 from the ring. The sealing member 20 of FIG. 6 is particularly suitable for use with the ring and lid of FIG. 2 because lines of weakness 22 in the disc are able to lie flat on the raised lid panel 15. The disc 21 is coated overall with a hot melt adhesive to permit attachment to the ring and lid. However, for economy the adhesive may be locally applied to an annular margin around the aperture 23 by a stencil coating process or the like. Localised coatings of adhesive will also permitt the tab 24 to be left free for easier lifting during removal of the seal.

Although the embodiments described use hot melt adhesive, applied to aluminium foil as an overall coating, to adhere the sealing member to the ring, localised coatings of the adhesive are also suitable. Furthermore, the use of other easily releasable adhesives applied either to the ring and lid or to the sealing means are also within the scope of the invention.

Whilst the invention has been described in terms of sealing members made from aluminium foil, which will have a good gas barrier performance, less impermeable materials such as plastics film or even paper may be used. Such frangible materials will serve in the tamperindicating function of the invention and provide a barrier to water vapour.

Figure 7:
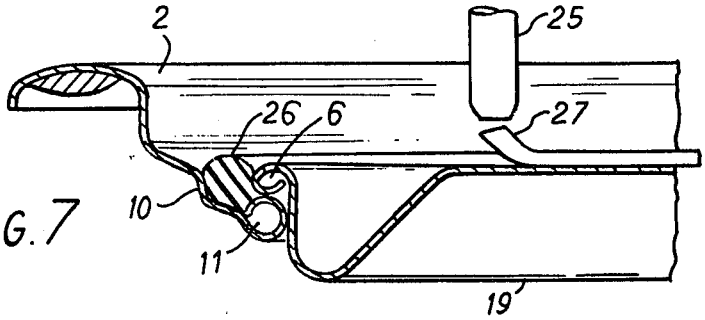
FIG. 7 is a side elevation of a ring and lid assembly sealed by an extruded sealant.

Furthermore, the sealing member may be made of a flowable material, such as polyvinyl chloride, directed from a nozzle 25 into the channel portion which is defined by the curl 6 of the lid 19 and the curl 11 and frustocnical portion 10 of the ring 2 as shown in FIG. 7. Upon setting or curing the flowable material forms a sealing member 26. A pull tab 27 may be provided by briefly continuing the supply of material after filling the channel.

I claim:

1. A lever lid and ring assembly for closing an end of a container body, said assembly comprising a ring, said ring having peripheral attaching means for attachment to a container body, a lever lid push fitted in the ring and removable therefrom for access to the interior of an associated container body, there being a joint between said ring and said lid, and a sealing member bridging the joint between the ring and the lid along the whole length of the joint, said sealing member having an outer periphery adhering to the ring and an inner portion adhering to the lid, said sealing member having a central opening, and a pull tab integral with said sealing member extending into said central opening.

2. The lever lid and ring assembly of claim 1 wherein said ring and said lever lid each has a continuous sealing surface, said sealing surfaces being recessed relative to said peripheral attaching means and lying generally in a common plane, said sealing surfaces being spaced and said sealing member bridging said space.

3. A lever lid and ring assembly according to claim 2 wherein the sealing member is formed of aluminum foil coated locally with an adhesive in alignment with said sealing surfaces.

4. A lever lid and ring assembly according to claim 2 wherein the sealing member is heat sealed to both the lid and ring sealing surfaces.

5. The lever lid and ring assembly of claim 2 wherein peripheral attaching means includes a chuck wall, and said sealing member lies within the space defined by said chuck wall.

6. The lever lid and ring assembly of claim 1 wherein peripheral attaching means includes a chuck wall, and said sealing member lies within the space defined by said chuck wall.

7. The lever lid and ring assembly of claim 1 wherein said sealing member covers a major portion of said lid, said central opening is relatively small in comparison to said lid, and said pull tab is defined outwardly of said central opening by a pair of lines of weakness.

8. The lever lid and ring assembly of claim 7 wherein only a terminal portion of said pull tab projects into said central opening.

9. The lever lid and ring assembly of claim 7 wherein said lid is recessed in underlying relation to said central opening and said pull tab.

10. The lever lid and ring assembly of claim 7 wherien said lid has a central surface underlying and supporting said pull tab and said sealing member surrounding said central opening.

* * * * *